US009752566B2

(12) United States Patent
Roberts et al.

(10) Patent No.: US 9,752,566 B2
(45) Date of Patent: Sep. 5, 2017

(54) AIR MASS CONTROL FOR DIAPHRAGM PUMPS

(71) Applicant: Ingersoll-Rand Company, Davidson, NC (US)

(72) Inventors: Jevawn Sebastian Roberts, Atlanta, GA (US); Michael Brace Orndorff, Douglasville, GA (US)

(73) Assignee: Ingersoll-Rand Company, Davidson, NC (US)

( * ) Notice: Subject to any disclaimer, the term of this patent is extended or adjusted under 35 U.S.C. 154(b) by 413 days.

(21) Appl. No.: 14/316,770

(22) Filed: Jun. 26, 2014

(65) Prior Publication Data

US 2015/0004003 A1 Jan. 1, 2015

Related U.S. Application Data

(60) Provisional application No. 61/839,703, filed on Jun. 26, 2013, provisional application No. 61/895,796, filed on Oct. 25, 2013.

(51) Int. Cl.

| | |
|---|---|
| ***F04B 43/073*** | (2006.01) |
| ***F04B 45/04*** | (2006.01) |
| ***F04B 45/053*** | (2006.01) |
| ***F04B 43/02*** | (2006.01) |

(52) U.S. Cl.

CPC ..... *F04B 43/073* (2013.01); *F04B 43/025* (2013.01); *F04B 43/026* (2013.01); *F04B 45/043* (2013.01); *F04B 45/0536* (2013.01)

(58) Field of Classification Search

CPC ..... F04B 9/133; F04B 9/129; F04B 9/131; F04B 43/02–43/026; F04B 43/0736; F04B 43/067; F04B 43/073; F04B 45/053–45/0536

USPC ..... 91/304, 307, 311, 313; 92/48–50; 417/384, 385, 392, 393, 395, 46

See application file for complete search history.

(56) References Cited

U.S. PATENT DOCUMENTS 3,741,689 A * 6/1973 Rupp ..... F01B 25/02 417/393

FOREIGN PATENT DOCUMENTS

CA 1172904 A * 8/1984 ..... F04B 43/073

OTHER PUBLICATIONS

U.S. Appl. No. 14/316,146; Diaphragm Pumps With Chamber Crossventing; Office Action Dated Oct. 6, 2016.

* cited by examiner

*Primary Examiner* — Alexander Comley
(74) *Attorney, Agent, or Firm* — Barnes & Thornburg LLP

(57) ABSTRACT

Diaphragm pumps, and pre-charging systems for use with such pumps, are disclosed. The diaphragm pump includes a first diaphragm that separates a cavity into a motive fluid chamber and a pumped media chamber, a charge chamber having a controlled volume, wherein the controlled volume is adjustable to vary a controlled mass of compressed fluid capable of being stored in the charge chamber, and one or more valves configured to (i) fluidly couple the motive fluid chamber to an exhaust chamber during a first stroke period, (ii) fluidly couple the charge chamber to a compressed fluid inlet during at least a portion of the first stroke period, and (iii) fluidly couple the charge chamber to the motive fluid chamber during a second stroke period.

3 Claims, 5 Drawing Sheets

AIR MASS CONTROL FOR DIAPHRAGM PUMPS

CROSS REFERENCE TO RELATED APPLICATIONS

This application claims the benefit of U.S. Provisional Patent Application No. 61/839,703, filed Jun. 26, 2013, and U.S. Provisional Patent Application No. 61/895,796, filed Oct. 25, 2013 (both entitled "Energy Efficiency Enhancements for Air Operated Diaphragm Pumps"). The entire disclosures of both of the foregoing applications are incorporated by reference herein.

TECHNICAL FIELD

The present disclosure relates, generally, to diaphragm pumps and, more particularly, to air mass control for diaphragm pumps.

BACKGROUND

Double diaphragm pumps alternately pressurize and exhaust two opposing motive fluid chambers to deliver pumped media during each stroke of the pump. Pressurizing the motive fluid chambers often results in operating efficiency losses as some of the motive fluid communicated to the chambers during each stroke does not contribute to the pumping action. In an attempt to mitigate this shortcoming, some prior pumps have interrupted the supply of motive fluid part of the way through each stroke to minimize the amount of motive fluid that does not contribute to the pumping action. Such pumps have typically implemented this interruption of motive fluid using electronic and/or electromechanical control systems.

SUMMARY

According to one aspect, a diaphragm pump may comprise a first diaphragm that separates a cavity into a motive fluid chamber and a pumped media chamber, the first diaphragm being configured to move reciprocally between a first end-of-stroke position and a second end-of-stroke position, a charge chamber having a controlled volume, wherein the controlled volume is adjustable to vary a controlled mass of compressed fluid capable of being stored in the charge chamber, and one or more valves configured to (i) fluidly couple the motive fluid chamber to an exhaust chamber during a first stroke period, such that the first diaphragm is allowed to move from the first end-of-stroke position to the second end-of-stroke position during the first stroke period, (ii) fluidly couple the charge chamber to a compressed fluid inlet during at least a portion of the first stroke period, such that the controlled mass of compressed fluid is supplied to the charge chamber during the first stroke period, and (iii) fluidly couple the charge chamber to the motive fluid chamber during a second stroke period, such that expansion of the controlled mass of compressed fluid in the motive fluid chamber causes the first diaphragm to move from the second end-of-stroke position to the first end-of-stroke position during the second stroke period.

In some embodiments, the charge chamber may be configured such that the controlled volume has a static value throughout the first and second stroke periods. The charge chamber may be configured such that the controlled volume varies dynamically from a minimum value to a maximum value during the first stroke period and from the maximum value to the minimum value during the second stroke period, the maximum value being adjustable to vary the controlled mass of compressed fluid. The diaphragm pump may further comprise a piston disposed in the charge chamber and configured to translate reciprocally within the charge chamber between (i) a first position corresponding to the controlled volume having the minimum value and (ii) a second position corresponding to the controlled volume having the maximum value. The diaphragm pump may further comprise an adjustment plate disposed in the charge chamber and configured to translate within the charge chamber to modify a distance between the first and second positions of the piston. The diaphragm pump may further comprise a second diaphragm disposed in the charge chamber and configured to move reciprocally within the charge chamber between (i) a first position corresponding to the controlled volume having the minimum value and (ii) a second position corresponding to the controlled volume having the maximum value. The second diaphragm may comprise opposing first and second sides, the first side partially bounding the controlled volume of the charge chamber and the second side partially bounding a control chamber, and a volume of fluid stored in the control chamber may be adjustable to modify a distance traveled by a center of the second diaphragm between the first and second positions.

In some embodiments, the diaphragm pump may further comprise an adjustment plate disposed in the charge chamber and configured to translate within the charge chamber to adjust the controlled volume. The diaphragm pump may further comprise a threaded shaft engaged with the adjustment plate and configured to be manually rotated to cause translation of the adjustment plate within the charge chamber. The diaphragm pump may further comprise an actuator engaged with the adjustment plate and configured to control translation of the adjustment plate within the charge chamber, a sensor configured to output a sensor signal indicative of a stroke speed of the first diaphragm, and a controller communicatively coupled to the actuator and the sensor, the controller configured to (i) receive the sensor signal, (ii) determine whether the stroke speed is outside a desired range, and (iii) transmit a control signal that causes the actuator to translate the adjustment plate within the charge chamber in response to determining that the stroke speed is outside the desired range.

According to another aspect, a pre-charging system for use with a double diaphragm pump that comprises a first diaphragm that separates a first cavity into a first motive fluid chamber and a first pumped media chamber, a second diaphragm that separates a second cavity into a second motive fluid chamber and a second pumped media chamber, a compressed fluid inlet, and a main valve movable between (i) a first main valve position in which the main valve fluidly couples the compressed fluid inlet to the first motive fluid chamber and (ii) a second main valve position in which the main valve fluidly couples the compressed fluid inlet to the second motive fluid chamber may comprise a charge unit including a first charge chamber having a first controlled volume and a second charge chamber having a second controlled volume, and a charge valve configured to be fluidly coupled to a compressed fluid source, the first charge chamber, the second charge chamber, and the compressed fluid inlet of the double diaphragm pump. The first controlled volume may be adjustable to vary a first controlled mass of compressed fluid capable of being stored in the first charge chamber and the second controlled volume may be adjustable to vary a second controlled mass of compressed fluid capable of being stored in the second charge chamber.

The charge valve may be movable between (i) a first charge valve position in which the charge valve is configured to communicate compressed fluid from the first charge chamber to the compressed fluid inlet and to communicate compressed fluid from the compressed fluid source to the second charge chamber and (ii) a second charge valve position in which the charge valve is configured to communicate compressed fluid from the second charge chamber to the compressed fluid inlet and to communicate compressed fluid from the compressed fluid source to the first charge chamber.

In some embodiments, the charge valve may be configured to (i) receive at least one pilot signal from the double diaphragm pump, (ii) shift the charge valve from the first charge valve position to the second charge valve position in response to a first change in the at least one pilot signal that causes the main valve to shift from the first main valve position to the second main valve position, and (iii) shift the charge valve from the second charge valve position to the first charge valve position in response to a second change in the at least one pilot signal that causes the main valve to shift from the second main valve position to the first main valve position.

In some embodiments, the pre-charging system may comprise a controller configured to (i) receive a sensor signal indicative of the first and second diaphragms of the double diaphragm pump reaching an end-of-stroke position and (ii) transmit a first control signal to the charge valve that causes the charge valve to shift between the first and second charge valve positions in response to receiving the sensor signal. The controller may be further configured to (i) determine a stroke speed of the double diaphragm pump using the sensor signal and (ii) transmit a second control signal that causes an actuator to adjust at least one of the first and second controlled volumes in response to the determined stroke speed being outside a desired range.

In some embodiments, the first and second controlled volumes may be independently adjustable such that the first controlled volume need not equal the second controlled volume. The first and second controlled volumes may be cooperatively adjustable such that the first controlled volume always equals the second controlled volume. The charge unit may further comprise a rodless piston separating the first and second charge chambers, the rodless piston being configured to translate within the charge unit to dynamically vary each of the first and second controlled volumes between a minimum value and a maximum value, the maximum value being adjustable to vary the first and second controlled masses of compressed fluid. The charge unit may further comprise an adjustment plate configured to translate within the charge unit to modify a distance traveled by the rodless piston between (i) a first position corresponding to the first controlled volume having the maximum value and to the second controlled volume having the minimum value and (ii) a second position corresponding to the second controlled volume having the maximum value and to the first controlled volume having the minimum value. The charge unit may further comprise a control chamber storing a volume of fluid, a third diaphragm that separates the first charge chamber from the control chamber, and a fourth diaphragm that separates the second charge chamber from the control chamber, the volume of fluid stored in the control chamber being adjustable to vary the first and second controlled masses of compressed fluid.

In some embodiments, the charge unit may further comprise a control chamber storing a volume of fluid, a third diaphragm that separates the first charge chamber from the control chamber, and a fourth diaphragm that separates the second charge chamber from the control chamber, the volume of fluid stored in the control chamber being adjustable to vary the first and second controlled masses of compressed fluid.

BRIEF DESCRIPTION OF THE DRAWINGS

The concepts described in the present disclosure are illustrated by way of example and not by way of limitation in the accompanying figures. For simplicity and clarity of illustration, elements illustrated in the figures are not necessarily drawn to scale. For example, the dimensions of some elements may be exaggerated relative to other elements for clarity. Further, where considered appropriate, reference labels may be repeated among the figures to indicate corresponding or analogous elements.

DETAILED DESCRIPTION OF THE DRAWINGS

Figure 1:
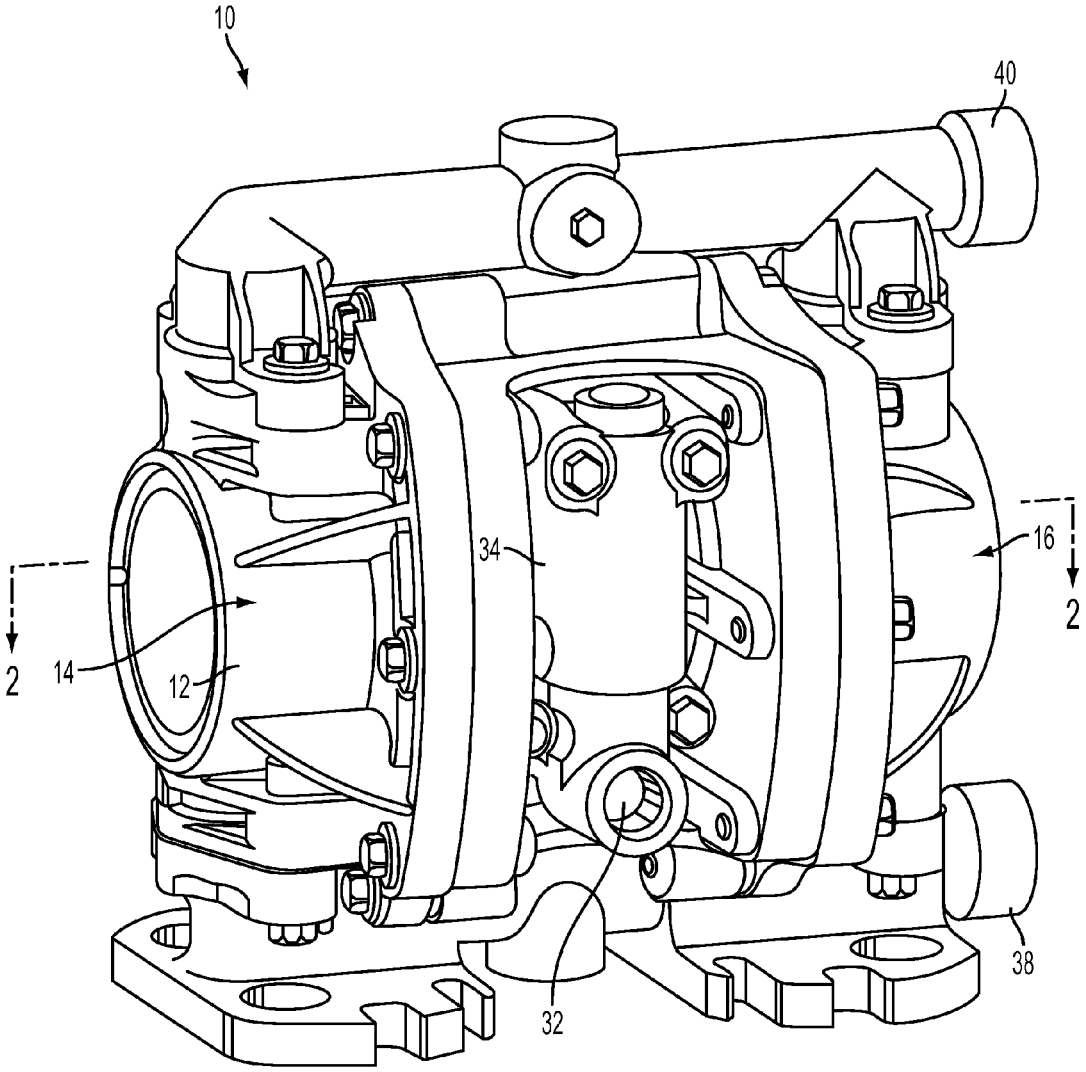
FIG. 1 is a front perspective view of one illustrative embodiment of a double diaphragm pump.

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the present disclosure.

Figure 2:
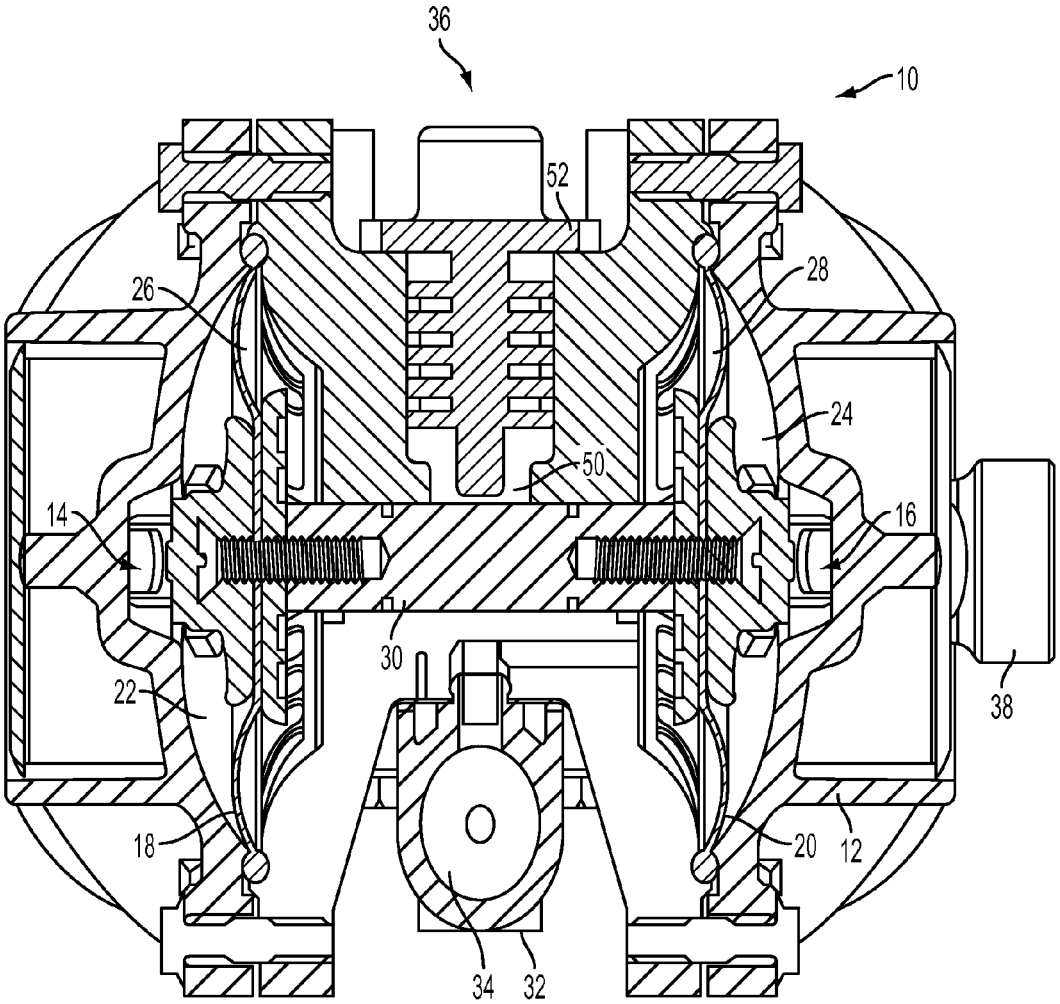
FIG. 2 is a cross-sectional view of the pump of FIG. 1, taken along the line 2-2 in FIG. 1.

Referring now to FIGS. 1 and 2, one illustrative embodiment of a diaphragm pump 10 is shown. The pump 10 of FIGS. 1 and 2 is illustratively embodied as an air-operated double diaphragm pump. It is contemplated that, in other embodiments, the pump 10 might be embodied as another type of diaphragm pump (or even another type of positive displacement pump). In the illustrative embodiment, the pump 10 has a housing 12 that defines a cavity 14 and a cavity 16. The housing 12 is illustratively comprised of three sections coupled together by fasteners. As best seen in FIG. 2, the cavities 14, 16 of the pump 10 are each separated by a respective flexible diaphragm 18, 20 into a respective pumped media chamber 22, 24 and a respective motive fluid chamber 26, 28. The diaphragms 18, 20 are interconnected by a shaft 30, such that when the diaphragm 18 is moved to increase the volume of the associated pumped media chamber 22, the other diaphragm 20 is simultaneously moved to decrease the volume of the associated pumped media chamber 24, and vice versa.

The shaft 30 illustrated in FIG. 2 is a reciprocating diaphragm link rod having a fixed length, such that the diaphragms 18, 20 move reciprocally together with the shaft 30. The shaft 30 and diaphragms 18, 20 move back and forth a fixed distance that defines a stroke. The fixed distance is determined by the geometry of the pump 10, the shaft 30, the diaphragms 18, 20, and other components of the pump 10. A stroke is defined as the travel path of the shaft 30 between end-of-stroke positions. Movement of the shaft 30 from one end-of-stroke position to the other end-of-stroke position and back defines a cycle of operation of the shaft 30 (i.e., a cycle includes two consecutive strokes).

The pump 10 includes a compressed fluid inlet 32 for the supply of a compressed fluid (e.g., compressed air, another pressurized gas, hydraulic fluid, etc.) and a main valve 34 for alternately supplying the compressed fluid to the motive fluid chambers 26, 28 to drive reciprocation of the diaphragms 18, 20 and the shaft 30. The main valve 34 is fluidly coupled between the inlet 32 and the motive fluid chambers 26, 28. When the main valve 34 supplies compressed fluid to the motive fluid chamber 26 (while in one position), the main valve 34 places an exhaust assembly 36 in communication with the other motive fluid chamber 28 to permit fluid to be expelled therefrom. Conversely, when the main valve 34 supplies compressed fluid to the motive fluid chamber 28 (while in another position), the main valve 34 places the motive fluid chamber 26 in communication with the exhaust assembly 36. In the illustrative embodiment of the pump 10, movement of the main valve 34 between these two positions is controlled by a pilot valve (not shown). In particular, the pilot valve provides a compressed fluid pilot signal to the main valve 34, where a pressure of the pilot signal changes in response to the diaphragms 18, 20 reaching an end-of-stroke position. In turn, this change in pressure of the pilot signal provided to the main valve 34 causes the main valve 34 to shift between its two positions.

The exhaust assembly 36 of the pump 10 includes an exhaust chamber 50 and a muffler 52 that is received in the exhaust chamber 50. In the illustrative embodiment, the main valve 34 alternately couples one of the motive fluid chambers 26, 28 (whichever of the motive fluid chambers 26, 28 is not being supplied with compressed fluid by the main valve 34) to the exhaust assembly 36 to allow any fluid in that motive fluid chamber 26, 28 to be vented to the atmosphere. It is contemplated that, in other embodiments, the pump 10 might use other mechanisms to selectively couple the motive fluid chambers 26, 28 to the exhaust assembly 36 (e.g., "quick dump check valves" positioned between the main valve 34 and the motive fluid chambers 26, 28).

During operation of the pump 10, as the main valve 34, the pilot valve, and the exhaust assembly 36 cooperate to effect the reciprocation of the diaphragms 18, 20 and the shaft 30, the pumped media chambers 22, 24 alternately expand and contract to create respective low and high pressure within the respective pumped media chambers 22, 24. The pumped media chambers 22, 24 each communicate with a pumped media inlet 38 that may be connected to a source of fluid to be pumped (also referred to herein as "pumped media") and also each communicate with a pumped media outlet 40 that may be connected to a receptacle for the fluid being pumped. Check valves (not shown) ensure that the fluid being pumped moves only from the pumped media inlet 38 toward the pumped media outlet 40. For instance, when the pumped media chamber 22 expands, the resulting negative pressure draws fluid from the pumped media inlet 38 into the pumped media chamber 22. Simultaneously, the other pumped media chamber 24 contracts, which creates positive pressure to force fluid contained therein to the pumped media outlet 40. Subsequently, as the shaft 30 and the diaphragms 18, 20 move in the opposite direction, the pumped media chamber 22 will contract and the pumped media chamber 24 will expand (forcing fluid contained in the pumped media chamber 24 to the pumped media outlet 40 and drawing fluid from the pumped media inlet 38 into the pumped media chamber 24).

Figure 3:
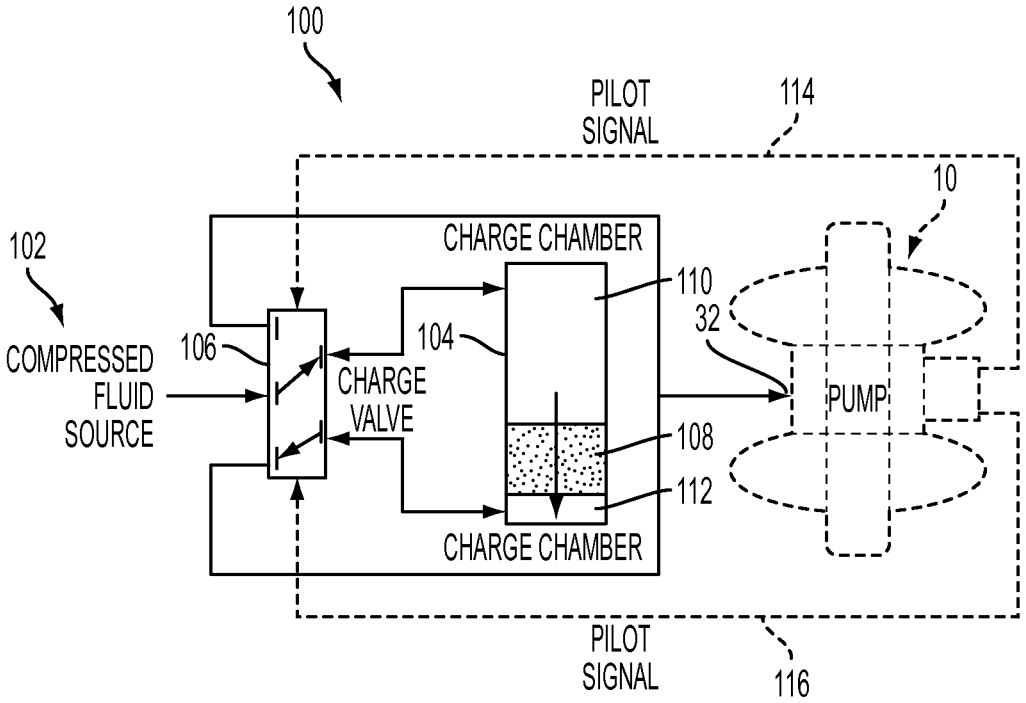
FIG. 3 is a diagrammatic view of one operating stage of a pre-charging system while being used with the pump of FIG. 1.

Referring now to FIG. 3, a pre-charging system 100 that may be used with the pump 10 is shown in a diagrammatic view. While the pre-charging system 100 is shown and described herein as being used with the pump 10, it will be appreciated that the pre-charging system 100 could be used to improve the operation of many other types of fluid-driven diaphragm pumps, as well as other types of fluid-driven positive displacement pumps. Furthermore, although the pre-charging system 100 is generally shown and described herein as being external to the pump 10, it is also contemplated that, in some embodiments, some or all of the components of the pre-charging system 100 may be incorporated directly into the pump 10.

Figure 4:
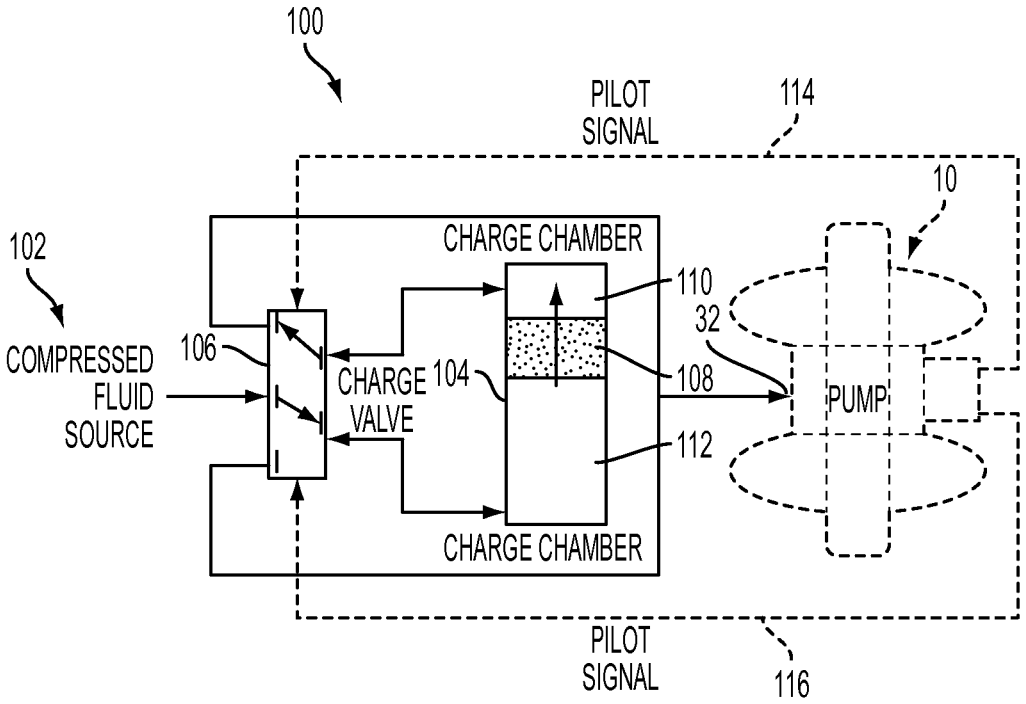
FIG. 4 is a diagrammatic view of another operating stage of the pre-charging system of FIG. 3 while being used with the pump of FIG. 1.

The pre-charging system 100 may be fluidly coupled between a compressed fluid source 102 and the compressed fluid inlet 32 of the pump 10, as illustrated in FIGS. 3-4. As described further below, when the pre-charging system 100 is used with the pump 10, the pre-charging system 100 improves the efficiency of the pump 10 and/or controls the speed of the pump 10 by delivering a controlled mass of compressed fluid to the pump 10 during each stroke. Generally described, the pre-charging system 100 includes a charge unit 104 and a charge valve 106. The charge unit 104 may include any number of charge chambers 110, 112. Each of the charge chambers 110, 112 has a controlled volume capable of storing a controlled mass of compressed fluid for subsequent delivery to the pump 10. In many of the illustrative embodiments of the present disclosure, the controlled volume of each of the charge chambers is adjustable, manually and/or automatically, to vary the controlled mass of compressed fluid that is capable of being stored in the respective charge chambers (see FIGS. 5-7).

In the illustrative embodiment of FIGS. 3-4, the charge unit 104 comprises a rodless piston 108 that separates an internal volume of the charge unit 104 into the charge chamber 110 and the charge chamber 112. The rodless piston 108 is able to translate within the internal volume of the charge unit 104 from one position at or near one end of the charge unit 104 (as suggested in FIG. 3) to another position at or near the other end of the charge unit 104 (as suggested in FIG. 4). Because the piston 108 is rodless, its translation within the charge unit 104 is not constrained by external forces, only the relative pressure of compressed fluid in each of the charge chambers 110, 112. As illustrated in FIGS. 3-4, as the piston 108 translates reciprocally within the charge unit 104, the piston 108 dynamically varies the controlled volumes of the charge chambers 110, 112. As mentioned above, the piston 108 is able to travel between one position at or near one end of the charge unit 104 and another position at or near the other end of the charge unit 104. When the piston 108 is in one of these end positions, the controlled volume of the charge chamber 110 will have a maximum value (relative to other possible positions of the piston 108), while the controlled volume of the charge chamber 112 will have a minimum value (again, relative to other possible positions of the piston 108). Conversely, when the piston 108 is in the other of its end positions, the controlled volume of the charge chamber 112 will have a maximum value, and the controlled volume of the charge chamber 110 will have a minimum value. It is contemplated that, in other embodiments of the pre-charging system 100, the piston 108 might instead be embodied as a flexible diaphragm that separates the charge chambers 110, 112.

The charge valve 106 includes a plurality of ports that may be fluidly coupled to the compressed fluid source 102, to the charge chamber 110, to the charge chamber 112, and to the compressed fluid inlet 32 of the pump 10, as illustratively shown in FIGS. 3-4. In some embodiments, the charge valve 106 may include a spool that is movable between various positions to make selective connections between the plurality of ports (similar to the main valve 34 of the pump 10). In the illustrative embodiment, the charge valve 106 is movable at least between a position in which the charge valve 106 makes the fluid connections shown diagrammatically in FIG. 3 and another position in which the charge valve 106 makes the fluid connections shown diagrammatically in FIG. 4.

When the charge valve 106 is in the position shown in FIG. 3, the charge valve 106 fluidly couples the compressed fluid source 102 to the charge chamber 110, such that compressed fluid is communicated to the charge chamber 110. As indicated in FIG. 3, the supply of compressed fluid to the charge chamber 110 causes the piston 108 to translate within charge unit 104, such that the controlled volume of the charge chamber 110 increases toward its maximum value. At the same time, the charge valve 106 fluidly couples the charge chamber 112 to the compressed fluid inlet 32 of the pump 10, such that a controlled mass of compressed fluid previously stored in the charge chamber 112 is communicated to the pump 10 (in particular, to one of the motive fluid chambers 26, 28 of the pump 10). Translation of the piston 108 within the charge unit 104 assists in expelling the compressed fluid from the charge chamber 112 during this stage of operation.

When the charge valve 106 is in the position shown in FIG. 4, the charge valve 106 fluidly couples the compressed fluid source 102 to the charge chamber 112, such that compressed fluid is communicated to the charge chamber 110. As indicated in FIG. 4, the supply of compressed fluid to the charge chamber 112 causes the piston 108 to translate within charge unit 104, such that the controlled volume of the charge chamber 112 increases toward its maximum value. At the same time, the charge valve 106 fluidly couples the charge chamber 110 to the compressed fluid inlet 32 of the pump 10, such that a controlled mass of compressed fluid previously stored in the charge chamber 110 is communicated to the pump 10 (in particular, to one of the motive fluid chambers 26, 28 of the pump 10). Translation of the piston 108 within the charge unit 104 assists in expelling the compressed fluid from the charge chamber 110 during this stage of operation.

In operation, the pre-charge system 100 cycles back-and-forth between the stages illustrated in FIGS. 3-4. As such, during each stage, one of the two charge chambers 110, 112 is receiving compressed fluid from the compressed fluid source 102, while the other of the two charge chambers 110, 112 is expelling a compressed fluid (that was received during the prior stage) to the inlet 32 of the pump 10. Due to the controlled volume of the charge chambers 110, 112 (in the illustrative embodiment, the maximum volume is achieved by each chamber 110, 112 when the piston 108 is at one of its end positions), a controlled mass of compressed fluid is supplied to each charge chamber 110, 112 during one stage, so that the controlled mass of compressed fluid can be delivered to the pump 10 during the next stage.

Furthermore, the operation of the pre-charge system 100 follows or mirrors that of the pump 10, such that the charge valve 106 is in the position shown in FIG. 3 while the main valve 34 of the pump 10 fluidly couples the inlet 32 to one of the two motive fluid chambers 26, 28 of the pump 10, and such that the charge valve 106 is in the position shown in FIG. 4 while the main valve 34 of the pump 10 fluidly couples the inlet 32 to the other one of the two motive fluid chambers 26, 28 of the pump 10. In other words, in the illustrative embodiment, the charge valve 106 shifts between the two positions illustrated in FIGS. 3-4 about the same time that the main valve 34 of the pump 10 shifts between its two positions. This synchronization allows the controlled masses of compressed fluid to be supplied to the motive fluid chambers 26, 28 at the appropriate times. By supplying the motive fluid chambers 26, 28 with controlled masses of compressed fluid (rather than continuously connecting the motive fluid chambers 26, 28 to the compressed fluid source 102 throughout each stroke), the controlled masses of compressed fluid are permitted to expand in the motive fluid chambers 26, 28 to do work on the diaphragms 18, 20. As such, the pre-charging system 100 typically results in lower pressure exhausted from the pump 10, which reflects less wasted energy.

In the illustrative embodiment of FIGS. 3-4, proper timing between the pre-charging system 100 and the pump 10 is maintained using a number of compressed fluid pilot signals 114, 116 received by the charge valve 106 from the pump 10. In particular, the pilot signals 114, 116 used by the charge valve 106 in the illustrative embodiment are the same compressed fluid pilot signals used by the pump 10 to control shifting of the main valve 34 of the pump 10. As discussed above, the pilot valve of the pump 10 provides at least one compressed fluid pilot signal 114 that changes in pressure in response to the diaphragms 18, 20 reaching an end-of-stroke position. This change in pressure of the pilot signal 114, provided to the charge valve 106, causes the charge valve 106 to shift to a new position. Another subsequent change in pressure of the pilot signal 114 (for instance, in response to the diaphragms 18, 20 reaching the other end-of-stroke position) may cause the charge valve 106 to shift back to its previous position. In the illustrative embodiment of FIGS. 3-4, pilot signal 116 is a constant pressure pilot signal that provides a reference point for variable pressure pilot signal 114. It will be appreciated that other configurations and control schemes for the pilot signal(s) 114, 116 are possible.

In other embodiments, the pre-charging system 100 avoids the use of any pilot signals 114, 116 from the pump 10 and, instead, utilizes a controller (not shown) to determine a state of the pump and instruct the charge valve 106 when it should shift positions. For instance, one or more sensors may be included in or on the pump 10 that output signals indicative of the diaphragms 18, 20 reaching an end-of-stroke position. For instance, inductance sensors, pressure sensors, reed switches, and other types of sensors might be used to sense an end-of-stroke condition of the pump 10. The controller may receive such a signal from one or more such sensors and utilize this information to determine the appropriate time for the charge valve 106 to shift positions. The controller can then transmit a control signal to the charge valve 106 (or some other intermediate device that controls the charge valve 106) to cause the charge valve 106 to shift positions.

Figure 5:
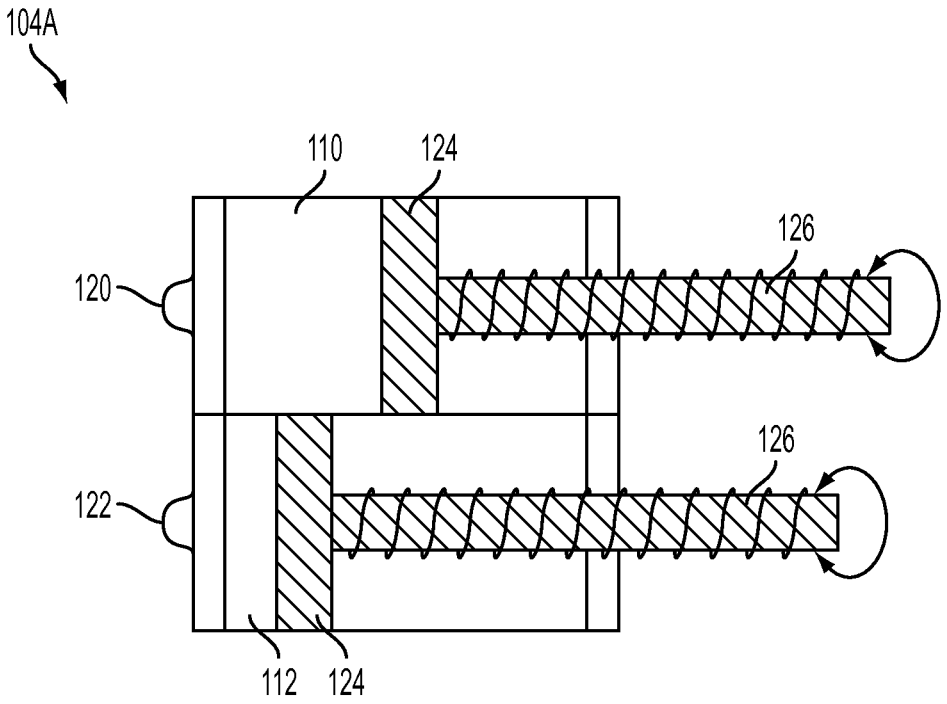
FIG. 5 is a cross-sectional view of one illustrative embodiment of a charge unit that may be used in the pre-charging system of FIG. 3.

Referring now to FIG. 5, one illustrative embodiment of an adjustable charge unit 104A is shown in a simplified cross-sectional view. The charge unit 104A may be used in the pre-charging system 100 discussed above. Like the charge unit 104 of FIGS. 3-4, the charge unit 104A includes a charge chamber 110 and a charge chamber 112. A port 120 of the charge unit 104A is used to fluidly couple the charge chamber 110 to one of the plurality of ports of the charge valve 106. Similarly, a port 122 of the charge unit 104A is used to fluidly couple the charge chamber 112 to another of the plurality of ports of the charge valve 106. Unlike the charge chambers 110, 112 of the charge unit 104 of FIGS. 3-4, however, the charge chambers 110, 112 of the charge unit 104A do not share a common movable wall (such as the piston 108). As such, the controlled volumes of the charge chambers 110, 112 of the charge unit 104A do not vary dynamically during the strokes of the pump 10 but, rather, have a static value throughout operation of the pump 10.

The foregoing feature allows for the controlled volumes of the charge chambers 110, 112 of the charge unit 104A to be adjustable independently of one another. In the illustrative embodiment of FIG. 5, an adjustment plate 124 is disposed in each of the charge chambers 110, 112. The adjustment plates 124 each translate (independently) within their respective charge chambers 110, 112 to adjust the respective controlled volumes of the charge chambers 110, 112. Independent adjustment of the controlled volumes of the charge chambers 110, 112 allows for a greater mass of compressed fluid to be provided to one of the motive fluid chambers 26, 28 of the pump 10 than the mass of compressed fluid provided to the other of the motive fluid chambers 26, 28 on opposing strokes of the pump 10. This feature may be used to compensate for asymmetric operation of the pump that occurs during equal masses of compressed fluid being provided to both motive fluid chambers 26, 28 of the pump 10. In the illustrative embodiment of FIG. 5, each of the adjustment plates 124 is engaged with a threaded shaft 126. Each of the threaded shafts 126 also engages threading on an end plate of the charge unit 104A, such that rotation of one of the threaded shafts 126 causes translation of that threaded shaft 126 and the engaged adjustment plate 124 with the corresponding charge chamber 110, 112. In some embodiments, the threaded shafts 124 may allow for manual adjustment of the control unit 104A.

Figure 6:
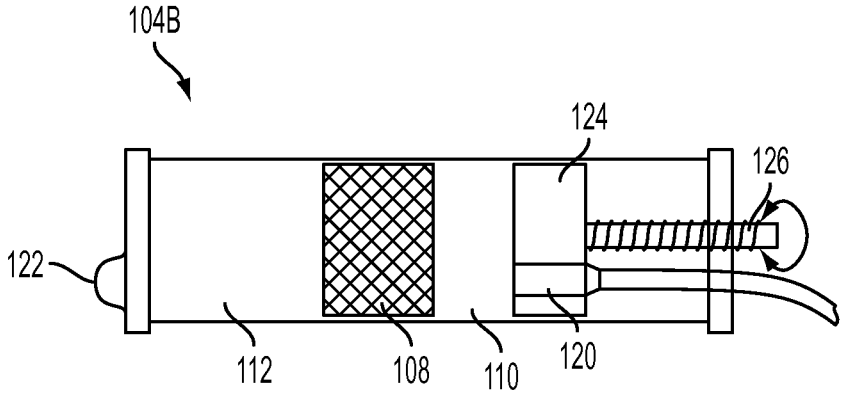
FIG. 6 is a cross-sectional view of another illustrative embodiment of a charge unit that may be used in the pre-charging system of FIG. 3.

Referring now to FIG. 6, another illustrative embodiment of an adjustable charge unit 104B is shown in a simplified cross-sectional view. The charge unit 104B may be used in the pre-charging system 100 discussed above. Like the charge unit 104 of FIGS. 3-4, the charge unit 104B includes a charge chamber 110 and a charge chamber 112 separated by a rodless piston 108. A port 120 of the charge unit 104A is used to fluidly couple the charge chamber 110 to one of the plurality of ports of the charge valve 106. Similarly, a port 122 of the charge unit 104A is used to fluidly couple the charge chamber 112 to another of the plurality of ports of the charge valve 106.

Similar to the adjustable charge unit 104A of FIG. 5, the charge unit 104B also includes an adjustment plate 124. As shown in FIG. 6, the adjustment plate 124 is disposed in the charge unit 104B adjacent the charge chamber 110. Due to the piston 108 dynamically varying the controlled volumes of the charge chambers 110, 112 during operation (as the piston translates back and forth within the charge unit 104B), translation of the adjustment plate 124 within the charge unit 104B adjusts the controlled volumes of both charge chambers 110, 112 (i.e., the maximum volume of both charge chambers 110, 112 will always be equal). In particular, as suggested in FIG. 6, translation of the adjustment plate 124 within the charge unit 104B modifies the distance that the piston 108 is able to travel. As such, translation of the adjustment plate 124 in the charge unit 104B modifies the maximum volume of both charge chambers 110, 112. In the illustrative embodiment of FIG. 6, the adjustment plate 124 is engaged with a threaded shaft 126. As discussed above, the threaded shaft 126 also engages threading on an end plate of the charge unit 104A, such that rotation of the threaded shaft 126 causes translation of that threaded shaft 126 and the adjustment plate 124 with the charge unit 104B. In some embodiments, the threaded shaft 124 may allow manual adjustment of the control unit 104B.

Figure 7:
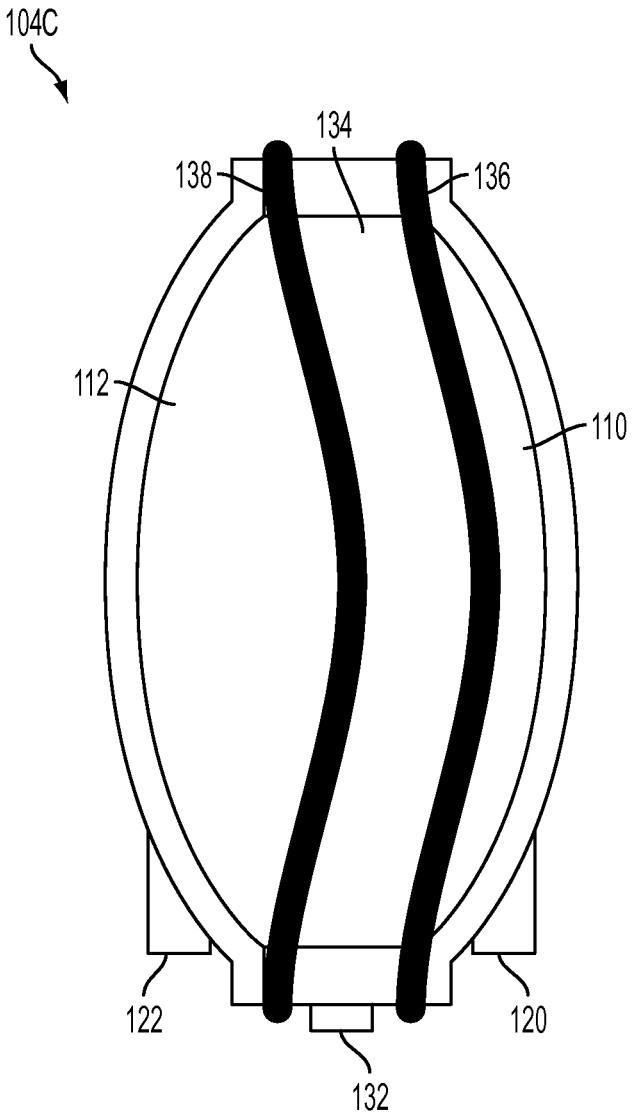
FIG. 7 is a cross-sectional view of yet another illustrative embodiment of a charge unit that may be used in the pre-charging system of FIG. 3.

Referring now to FIG. 7, yet another illustrative embodiment of an adjustable charge unit 104C is shown in a simplified cross-sectional view. The charge unit 104C may be used in the pre-charging system 100 discussed above. Like the charge unit 104 of FIGS. 3-4, the charge unit 104C includes a charge chamber 110 and a charge chamber 112. In addition, however, the charge unit 104C also includes a control chamber 134 positioned between the charge chambers 110, 112. A flexible diaphragm 136 separates the charge chamber 110 from the control chamber 134, while a flexible diaphragm 138 separates the charge chamber 112 from the control chamber 134. A port 120 of the charge unit 104C is used to fluidly couple the charge chamber 110 to one of the plurality of ports of the charge valve 106. Similarly, a port 122 of the charge unit 104C is used to fluidly couple the charge chamber 112 to another of the plurality of ports of the charge valve 106. An additional port 132 may be used to add or remove fluid from the control chamber 134, as discussed further below.

As suggested by FIG. 7, the diaphragms 136, 138 of the charge unit 104C are configured to move reciprocally within the charge unit 104C to dynamically vary the controlled volumes of the charge chambers 110, 112 throughout each stroke of the pump 10. In particular each of the diaphragms 136, 138 of the charge unit 104C each move between a position in which the controlled volume of the charge chamber 110 has a maximum value, while the controlled volume of the charge chamber 112 has a minimum value, and a position (see FIG. 7) in which the controlled volume of the charge chamber 112 has a maximum value, while the controlled volume of the charge chamber 110 has a minimum value.

As mentioned above, the port 132 may be used to add or remove fluid from the control chamber 134 that is disposed between the two charge chambers 110, 112. As can be appreciated from FIG. 7, depending on the volume of the fluid present in the control chamber 134, the available distance to be traveled by the diaphragms 136, 138 may be increased or decreased, correspondingly increasing or decreasing the maximum volumes that may be achieved by the controlled volumes of the charge chambers 110, 112 of the charge unit 104C. In at least some embodiments, the fluid disposed in the control chamber 134 may be an incompressible fluid.

Each of the adjustable charge units 104A, 104B, 104C described above permits manual adjustment of the controlled volumes of the charge chambers 110, 112 to vary the controlled mass of compressed fluid capable of being stored by those charge chambers 110, 112. This, in turn, allows control of the controlled masses of compressed fluid that are provided to the motive fluid chambers 26, 28 of the pump 10 (and, hence, control over various efficiency, speed, and/or other operating characteristics of the pump 10). In addition to manual adjustment, it is also contemplated that any of the illustrative charge units 104A, 104B, 104C (or any other adjustable charge units that might be used with the pre-charging system 100) might alternatively be electromechanically controlled. Rotation of the threaded shafts 126 could be driven by an electric motor. The threaded shafts 126 could be replaced with another type of actuator, such as a pneumatic or hydraulic piston, to control translation of the adjustment plate(s) 124. Similarly, filling and emptying of the control chamber 134 of the charge unit 104C could be controlled by electromechanical valves. As such, it is also contemplated that a controller could be used to automatically control adjustment of the controlled volumes of the charge chambers 110, 112. For instance, a controller might receive a signal indicative of a stroke speed of the pump (from any of the exemplary sensors described above for sensing an end-of-stroke condition). Using this signal, the controller could determine whether the sensed stroke speed was within or outside a desired range. If the stroke speed was outside the desired range, the controller could then transmit a control signal to the proper electromechanical actuator to cause translation of one of the adjustment plates 124 described above (or, alternatively, filling or emptying of the control chamber 134).

While certain illustrative embodiments have been described in detail in the figures and the foregoing description, such an illustration and description is to be considered as exemplary and not restrictive in character, it being understood that only illustrative embodiments have been shown and described and that all changes and modifications that come within the spirit of the disclosure are desired to be protected. There are a plurality of advantages of the present disclosure arising from the various features of the apparatus, systems, and methods described herein. It will be noted that alternative embodiments of the apparatus, systems, and methods of the present disclosure may not include all of the features described yet still benefit from at least some of the advantages of such features. Those of ordinary skill in the art may readily devise their own implementations of the apparatus, systems, and methods that incorporate one or more of the features of the present disclosure.

The invention claimed is:

1. A diaphragm pump comprising: a first diaphragm that separates a cavity into a motive fluid chamber and a pumped media chamber, the first diaphragm being configured to move reciprocally between a first end-of-stroke position and a second end-of-stroke position; a charge unit that includes first and second charge chambers therein; wherein the first and second charge chambers are adjustable in size by a piston that is movable between the first and second charge chambers in the charge unit; wherein each of the first and second charge chambers accommodates a controlled volume capable of storing a controlled mass of compressed fluid for subsequent delivery to the diaphragm pump; wherein the controlled volume of each of the first and second charge chambers is adjustable to vary the controlled mass of compressed fluid by changing the size of each of the first and second charge chambers by moving the piston in the charge unit in either a first direction or a second direction; wherein when the piston is moved in the charge unit in the first direction to a first end position, the controlled volume of the first charge chamber has a maximum value, while the controlled volume of the second charge chamber will have a minimum value; wherein when a first supply of compressed fluid fills the first charge chamber the piston moves within the charge unit such that the controlled volume of the first charge chamber increases to the maximum value of the first charge chamber; wherein a charge valve fluidly couples the second charge chamber to a compressed fluid inlet of the diaphragm pump, such that the controlled mass of compressed fluid previously stored in the second charge chamber is moved to the diaphragm pump; wherein when the piston is moved in the charge unit to a second end position opposite the first end position, the controlled volume of the second charge chamber has a maximum value, and the controlled volume of the first charge chamber will have a minimum value; wherein when a second supply of compressed fluid fills the second charge chamber the piston moves within the charge unit such that the controlled volume of the second charge chamber increases to the maximum value of the second charge chamber; wherein the charge valve fluidly couples the first charge chamber to the compressed fluid inlet of the diaphragm pump, such that the controlled mass of compressed fluid previously stored in the first charge chamber is moved to the diaphragm pump.

2. A pre-charging system for use with a double diaphragm pump that comprises a first diaphragm that separates a first cavity into a first motive fluid chamber and a first pumped media chamber, a second diaphragm that separates a second cavity into a second motive fluid chamber and a second pumped media chamber, a compressed fluid inlet, and a main valve movable between (i) a first main valve position in which the main valve fluidly couples the compressed fluid inlet to the first motive fluid chamber and (ii) a second main valve position in which the main valve fluidly couples the compressed fluid inlet to the second motive fluid chamber, the pre-charging system comprising:

a charge unit comprising a first charge chamber having a first controlled volume and a second charge chamber having a second controlled volume, wherein the first controlled volume is adjustable to vary a first controlled mass of compressed fluid capable of being stored in the first charge chamber and the second controlled volume is adjustable to vary a second controlled mass of compressed fluid capable of being stored in the second charge chamber;

a charge valve configured to be fluidly coupled to a compressed fluid source, the first charge chamber, the second charge chamber, and the compressed fluid inlet of the double diaphragm pump, wherein the charge valve is movable between (i) a first charge valve position in which the charge valve is configured to communicate compressed fluid from the first charge chamber to the compressed fluid inlet and to communicate compressed fluid from the compressed fluid source to the second charge chamber and (ii) a second charge valve position in which the charge valve is configured to communicate compressed fluid from the second charge chamber to the compressed fluid inlet and to communicate compressed fluid from the compressed fluid source to the first charge chamber; and a controller configured to (i) receive a sensor signal indicative of the first and second diaphragms of the double diaphragm pump reaching an end-of-stroke position and (ii) transmit a first control signal to the charge valve that causes the charge valve to shift between the first and second charge valve positions in response to receiving the sensor signal; (iii) determine a stroke speed of the double diaphragm pump using the sensor signal and (iv) transmit a second control signal that causes an actuator to adjust at least one of the first and second controlled volumes in response to the determined stroke speed being outside a desired range.

3. The pre-charging system of claim 2, wherein the charge valve is configured to (i) receive at least one pilot signal from the double diaphragm pump, (ii) shift the charge valve from the first charge valve position to the second charge valve position in response to a first change in the at least one pilot signal that causes the main valve to shift from the first main valve position to the second main valve position, and (iii) shift the charge valve from the second charge valve position to the first charge valve position in response to a second change in the at least one pilot signal that causes the main valve to shift from the second main valve position to the first main valve position.

* * * * *